United States Patent [19]

Dupre

[11] Patent Number: 4,993,635

[45] Date of Patent: Feb. 19, 1991

[54] PORTABLE SNOW MAKING TOWER

[76] Inventor: Herman K. Dupre, Seven Springs, Champion, Pa. 15622

[21] Appl. No.: 438,616

[22] Filed: Nov. 20, 1989

[51] Int. Cl.[5] ..... F25C 3/04

[52] U.S. Cl. ..... 239/14.2; 239/276; 239/281; 248/166

[58] Field of Search ..... 239/2.2, 14.2, 273, 239/276, 280, 280.5, 281; 248/165, 166

[56] References Cited

U.S. PATENT DOCUMENTS

| | | | |
|---|---|---|---|
| 902,863 | 11/1908 | Darrow | 239/273 |
| 1,213,409 | 1/1917 | Pfeifer | 248/166 |
| 2,984,444 | 5/1961 | Lewis | 248/166 |
| 3,010,660 | 11/1961 | Barrett . | |
| 3,298,612 | 1/1967 | Torrens . | |
| 3,464,625 | 9/1969 | Carlson . | |
| 3,761,020 | 9/1973 | Tropeano et al. | 239/14.2 X |
| 3,822,825 | 7/1974 | Dupre . | |
| 3,952,949 | 4/1976 | Dupre . | |
| 3,964,682 | 6/1976 | Tropeano et al. | 239/2.2 |
| 4,275,833 | 6/1981 | Fairbank | 239/2.2 |
| 4,682,729 | 7/1987 | Doman et al. | 239/2.2 |

FOREIGN PATENT DOCUMENTS

| | | | |
|---|---|---|---|
| 1005629 | 4/1952 | France | 239/280.5 |

*Primary Examiner*—Andres Kashnikow
*Assistant Examiner*—William Grant
*Attorney, Agent, or Firm*—Carothers and Carothers

[57] ABSTRACT

A portable snow making tower including an elongated metallic water pipe or conduit having a first discharge nozzle adjacent the upper edge thereof and an air supply conduit extending substantially coextensive with and secured with the water conduit. The air conduit is provided with an air discharge orifice adjacent the upper end thereof which is positioned such that the orifice discharge air therefrom under pressure in the form of a jet stream which is directed into the water discharged from the water nozzle to form a plume of atomized water at the top of the tower for making snow. The water conduit and air conduit are positioned at an incline and supported intermediate their upper and lower ends by two legs pivotally attached to the water conduit at the upper ends of the legs, and with the bottom ends of the legs spread thereby forming a tripod configuration which may be collapsed by pivoting the legs inwardly toward the water conduit. At least one of these legs are adjustable in length to permit extension thereof to accomodate sloping ground surfaces and the bottom of the two legs are adapted for sliding along a ground surface when the tower is being towed by the bottom end of the water conduit.

14 Claims, 3 Drawing Sheets

FIG. 4
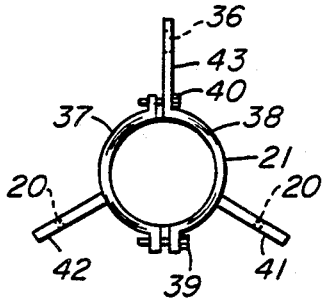
FIG. 3
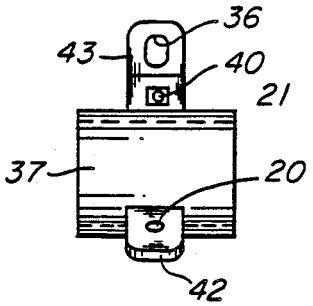
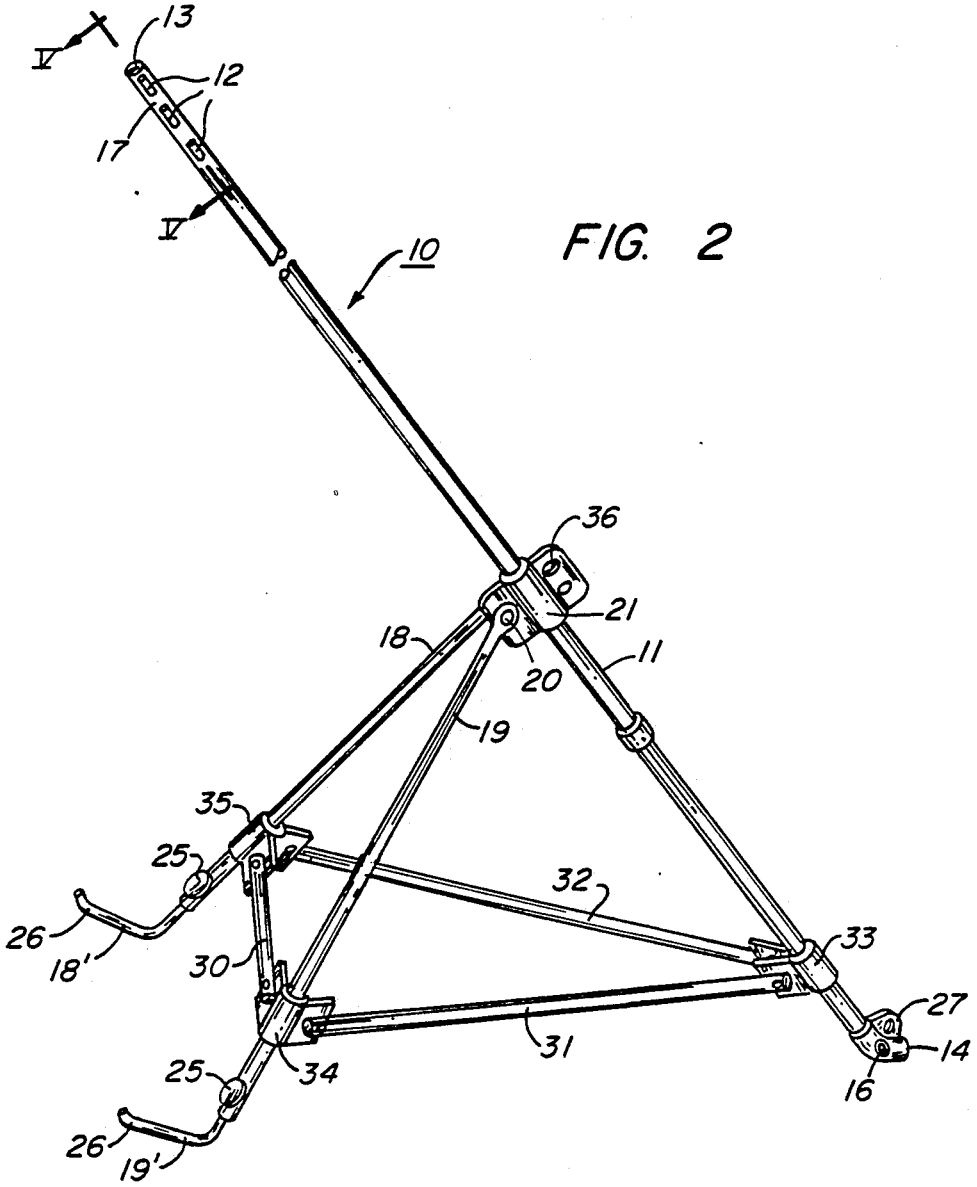
FIG. 2

PORTABLE SNOW MAKING TOWER

BACKGROUND OF THE INVENTION

The present invention pertains to portable apparatus for making snow.

This snow is generally made artificially for ski slopes by the use of stationary equipment or by the use of moveable or portable equipment. Examples of stationary type equipment for producing snow are snow making towers, such as disclosed in my U.S. Pat. No. 3,822,825 and U.S. Pat. No. 3,952,949. Other stationary snow producing apparatus consist of relatively large blower fans mounted on top of a relatively short pole or support and having a central water discharge in front of the fan.

Obviously, a problem existing with stationary snow making apparatus is that due to wind and other weather conditions, such as temperature, sun exposure, etc., areas of the ski slope to be surfaced by stationary equipment may not be adequately covered with snow and the only effective way to compensate for this is to bring in portable snow making units to produce smaller quantities of snow in the sparse areas.

The portable type snow making apparatus presently available generally consist of two types. One type is generically referred to as a snow gun and the other may be referred to as a fan blower unit.

The snow gun type of portable unit generally consists of a relatively short structure which may be readily handled and moved about by an individual and is supplied with compressed air and water which is delivered to a mixing chamber in the gun wherein the compressed air and water under pressure are mixed and a nucleated water spray is ejected from the mixing chamber into the ambient freezing atmosphere. Examples of such snow guns are shown in U.S. Pat. No. 3,010,660; 3,298,612 and 3,464,625.

The problems encountered with portable snow guns is that, while they are very mobile, they can not efficiently produce snow of adequate quality in large enough quantities. They are also prone to easily freeze up at the discharge nozzle thereby rendering them ineffective and tend to collect large quantities of ice on the exterior thereof rendering them inmobile and ineffective. These same shortcomings also prevent the snow guns from being constructed with any adequate height above ground. All of these shortcomings taken together prevent snow guns from being an effective large quantity producer of good quality snow and also prevent them from providing an adequately wide area of snow distribution over the ski slope in front of the snow gun.

The blower type portable ground unit consists of a large fan driven by a relatively large motor (15 HP) with a water nucleator positioned in front of the fan. The fan blower unit also carries an air compressor with it (another 5 HP) and the air supplied under pressure from this compressor is mixed with water supplied to the unit under pressure in an internal mixing chamber and then this mixture is ejected in a form of a nucleated spray in front of the fan. Additional water discharge nozzles are also circumferentially positioned about the fan and this additional water supply may be regulated depending upon the ambient temperatures.

While this blower type unit is indicated as being portable, in reality it is quite heavy and most probably weighs in the area of 600 lbs. It is therefore moved about the ski slope with the aid of a motorized vehicle.

For safety reasons, the fan blade is enclosed within a cage provided with a cowling for flying ice and the cage can readily collect ice which restricts the efficiency of the operation of the machine.

Also, in view of the fact that this portable unit is positioned at ground level, the ground surface distribution is limited. Furthermore, in view of the fact that the water nucleation is created in an internal chamber wherein the water under pressure and the air under pressure are mixed, the maximum usable water pressure for nucleation is limited to the air pressure value then utilized since a greater water pressure would cause the water to back down the air supply tube.

In addition, these fan blower type systems are comprised of many moveable parts which are of course subject to breakage and continual maintenance and other parts of the machinery are also subject to rust. Accordingly, after the ski season is over, such an expensive unit will normally be stored indoors in order to minimize damage due to exposure to the elements. In regard to cost, such units are also quite expensive in view of their large and complex nature. In addition, they also require a considerable amount of energy consumption per minute for operation, about 35 HP per minute.

Such blower units are also limited in their production of snow at warmer temperatures. For example, if such a blower system is operated at an ambient temperature of 28 degrees F it will be limited to a maximum useable water consumption rate which is probably in the area of 35 gals./min. Larger rates for production of snow would certainly be desirable. They also require considerable adjustment of the circumferentially positioned water nozzles for changing temperature and humidity conditions.

SUMMARY OF THE INVENTION

It is a principal object of the invention to provide a portable snow making apparatus which is light weight and therefore truly portable in the sense that it is easily moved about the ski slopes and which further is in the form of a snow tower, as opposed to the relatively short snow gun and fan blower units of the prior art.

The portable snow making tower of the present invention basically consists of an elongated water conduit which has at least one discharge nozzle (generally referred to as first discharge nozzle means) provided adjacent the upper end thereof and a coupling or other attachment means at the lower end of the water conduit for supplying water therein under pressure, and an air conduit extending substantially coextensive with and secured with this water conduit. The air conduit is provided with an air discharge orifice adjacent its upper end and the orifice is positioned to discharge air therefrom under pressure which is directed into the water discharge from the nozzle means to thereby form a plume of atomized water for making snow. A connector or other attachment means is provided at the bottom of this air conduit for supplying air therein under pressure.

The water conduit, along with the air conduit, is positioned at an incline and supported intermediate its upper and lower ends by two legs pivotally attached thereto at their upper ends. The legs are spread at their bottom ends thereby forming a tripod configuration, including the water conduit and the two legs, which may be collapsed by pivoting the legs inwardly towards the water conduit.

A stop is desirably provided for the pivotal travel of the legs away from the water conduit to an outer predetermined limit in order to stablize this tripod configuration. In addition, at least one of the legs are extendable, such as by telescopic extension, so that the tripod configuration can be adjusted to properly seat or rest on a slope or nonuniform ground surface.

The bottom of the two legs are also provided with some type of skid means, such as skids, wheels, or rounded end caps to permit the legs to slide along a surface when the entire snow tower tripod configuration is being towed about the ski slopes from the bottom end of the water conduit. For towing purposes, the bottom end of the water conduit is provided with an appropriate attachment to secure it to a motorized vehicle for towing.

In one form, the stop means utilized to limit the outward pivotal movement of the legs away from the water conduit may be provided in the form of cross-bracing between the legs and also between the respective legs and the water conduit.

Furthermore, in order to accomodate the adjustability of the tower to meet the different ground slope and terrain conditions, the connections between this cross-bracing and the legs and the water conduit can respectively be made adjustably slideable up and down the legs and the water conduit. In a similar manner, it is also preferrable if the pivotal connection of the upper ends of the two legs is also made adjustably slideable along the water conduit.

When the cross-bracing mechanism is utilized, one end of each of the cross-braces is provided with a detachable connection so that each of the cross-braces may be readily pivoted at their respective other ends and folded up against the legs or the water conduit in order to collapse the tripod unit.

It is also desirable to provide a pickup eye or the like either on or near the pivotal slide connection at the top of the legs so that the entire unit may be picked up or readily manuevered from this position.

In order to provide adequate dwell time for the formation of snow from the time that the plume is originally formed to the time that the seed crystals within the plume are transformed into snow flakes and light on the ground, it is imperative that the portable snow tower be as tall as possible and therefore the water conduit should be at least fifteen feet long and thirty foot lengths or more are preferrable, thirty to thirty-seven feet being typical.

In addition, it is also preferrable that the water conduit, the air conduit, and in fact the legs and as much of the portable tower structure as possible be manufactured of a light material such as aluminum. Also, in the preferred embodiment of the present invention, the air conduit is enclosed coaxially within the water conduit so that the water within the water conduit will move about the air conduit thereby insulating it and preventing the moisture in the air line from freezing. To accomplish this, the air conduit should be fabricated from a good thermally conducting material such as aluminum pipe so that the heat is readily transferred from the water to the interior of the air conduit. In a similar manner, the water conduit should also be fabricated of a good conducting material such as aluminum so that the heat of the water moving therein will prevent the build up of ice on the exterior of the water conduit. This insulation principal is illustrated in my prior U.S. Pat. Nos. 3,822,825 and 3,952,949. The tubular construction of the entire unit also permits easier removal of surface ice, as opposed to units constructed of angular stock.

In order to make the portable snow making tower of the present invention even more efficient, a second or additional discharge nozzle or nozzles may be also positioned adjacent to the first discharge nozzle means and connected to the same water supply within the interior of the water conduit to provide at least one additional water discharge at the top of the portable tower such that these additional water spray or sprays are directed into the aforedescribed plume of atomized water which is formed by the original water nozzle in combination with the air jet stream. This latter mentioned principal of utilizing additional water discharge nozzles at the top of the tower is explained and described in greater detail in my copending U.S. patent application entitled METHOD AND APPARATUS FOR MAKING SNOW, filed on the same date as this application.

The apparatus of the present invention provides for the first time a truly portable snow making tower which can produce snow with a greater dwell time and with greater quality in larger quantities with wider distribution and with much greater efficiency than ever thought herebefore possible for any portable snow making unit. The portable snow making tower of the present invention has the ability to make excellent quality snow in subfreezing ambient conditions at the water consumption rate of up to 50 gal./min. with a mere air consumption rate of 40 CFM, even at relatively warm subfreezing temperatures such as 28 degrees F., which is not possibly obtainable by any of the prior art snow making apparatus, portable or otherwise, and no adjustments are required-the unit is simply turned on.

BRIEF DESCRIPTION OF THE DRAWINGS

Other objects and advantages appear in the following descriptions and claims.

The accompanying drawings show, for the purpose of exemplification without limiting the invention or claims thereto, certain practical embodiments illustrating the principals of this invention wherein:

FIG. 2 is a perspective view showing another embodiment of the portable snow making tower of the present invention.

FIG. 3 is an enlarged view in side elevation illustrating the detail of the central slide and lifting attachment of the portable snow making tower shown in FIG. 2.

FIG. 4 is a right end view of the attachment shown in FIG. 3.

DETAILED DESCRIPTION OF THE PREFERRED EMBODIMENTS

Figure 1:
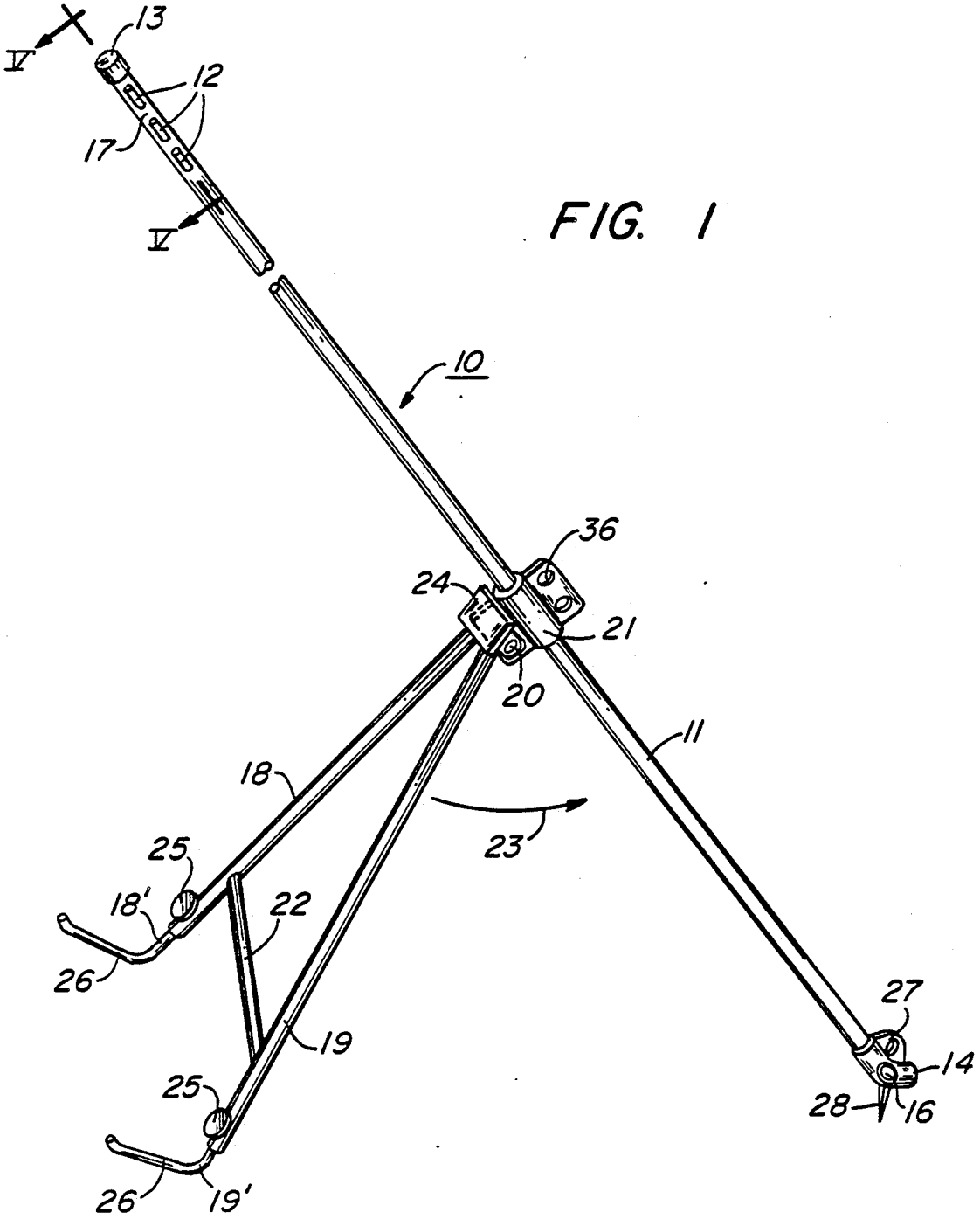
FIG. 1 is a perspective view showing one embodiment of the portable snow making tower of the present invention.

With reference to FIG. 1, one embodiment of the portable snow making tower 10 of the present invention is shown which includes an elongated water conduit 11 fabricated of aluminum and having discharge nozzle means or water discharge nozzle 12 provided adjacent the upper end thereof. The upper most end of the water conduit 11 is capped off as indicated at 13. A water supply line (not shown) is attached to the lower end of water conduit 11 at coupling junction 14 in order to supply water under pressure within the water conduit.

An air conduit is also provided which extends substantially coextensive with and is secured with water conduit 11. In the embodiment of FIG. 1, this air conduit is coaxially secured within water conduit 11 and is therefore not seen in the embodiment. However, it may be seen and is indicated as a conduit 15 in FIG. 5. This air conduit is also fabricated of aluminum. The lower end of air conduit 15 is provided with a coupling means for attaching an air supply line (not shown) thereto at coupling junction 16, which provides a passage through the housing of water coupling 14 and connects to the interior of coaxial air supply line 15.

The upper end of air conduit 15 is provided with a pair of air orifices 17 which pass through the outer wall of water conduit 11 and are further positioned to discharge air therefrom under pressure which is directed into the water discharged from the center nozzle of the three in line nozzles indicated at 12 in FIG. 1 in order to form a plume of atomized water for making snow. This structure will be described in greater detail hereinafter with particular reference to FIG. 5.

As noted in FIG. 1, the water conduit 11 is positioned at an incline and supported intermediate at upper and lower ends by two legs 18 and 19 which are pivotally attached at 20 to water conduit 11 via the slideable or adjustable clamp coupling attachment 21.

The bottom end of legs 18 and 19 are spread thereby forming a tripod configuration, including water conduit 11.

In this embodiment, legs 18 and 19 are ridgedly secured to each other by cross-brace 22 thereby providing a ridged A-frame bipod leg structure so that the entire portable snow tower 10 shown as a tripod configuration may be collapsed by pivotally folding bipod leg structure 18, 19 and 22 inwardly against water conduit 11 as indicated by arrow 23.

When the bipod leg structure is fully extended in its outwardly most pivoted position as illustrated in FIG. 1, a stop means in the form of stop plate 24, which is welded to coupling attachment 21, is provided to engage and stop further outward pivotal movements of legs 18 and 19 beyond this outer predetermined limit to stabilize the tripod configuration.

In addition, both legs 18 and 19 are extendable by means of bottom leg extension 18' and 19' respectively which are telescopically received within the hollow interior of legs 18 and 19 and may be clamped in a readjusted position by means of clamp screws 25 which are threadably received through the side wall of legs 18 and 19 respectively to engage and hold the otherwise slideable leg portions 18' and 19'.

The bottom end of legs 18 and 19 are also provided with skids 26 which permit legs 18 and 19 to slide along a ground surface when the bottom end of water conduit 11 is picked up and towed, as by the tow attachment coupling or ring 27. The skid 26 in this instance are nothing more than bent or welded segments of the tubing which forms the telescopic bottom leg sections 18' and 19' respectively.

An anchoring spur 28 is also provided at the bottom of water conduit 11 for anchoring the tripod configuration into the ground. One need only to step on top of the tow ring 27 and push the same into the snow or ground to assist in stabilizing the tripod configuration.

Reference is now made to the embodiment of the portable snow making tower of the present invention as illustrated in FIG. 2. Like elements are indicated with the same reference numerals. The major differences between the embodiment of FIG. 2 as opposed to that illustrated in FIG. 1 is that the stop means here is provided by means of three cross-braces 30, 31 and 32, instead of the stop plate mechanism 24 in combination with a rigid bipod leg structure.

Each of these cross-braces 30, 31 and 32 are readily detachable at one end so that they may be respectively pivoted upwardly to permit collapsing or folding of the entire tripod configuration. In this illustration, the right hand end of cross-braces 31 and 32 are pivotedly attached to pipe clamp slide coupling 33 and the opposite ends thereof are respectively connected by means of a simple pin arrangement to respective adjustable slide clamp couplings 34 and 35. In this manner, the left hand end of cross-brace members 31 and 32 may be disconnected by removal of a pin and thereby disconnected from their respective couplings 34 and 35 and then pivoted upwardly against water conduit 11. In a similar manner, the right hand end of cross-brace 30 between legs 18 and 19 is also detachably connected by a simple pin arrangement to coupling 34 so that it may be pivoted upwardly and swung against leg 18.

In order to permit maximum adjustability of the tripod configuration, attachment couplings 33, 34 and 35 are all slideable about their respective pipes to adjust their vertical height therealong and they may be then clamped to hold them in position.

Similarly, attachment 21 may also be adjustably slid and up and down water conduit 11 and thereafter set in position. Attachment 21 is also provided with a lifting eye 36 to assist in maneuvering the entire portable tower unit, such as to pull it over on to the ground or to raise the unit up onto its tripod configuration. This coupling attachment 21 is illustrated in greater detail in FIG. 3 and 4.

Referring to FIG. 3 and 4 the body of attachment 21 is comprised of two sleeve halves 37 and 38 which permits the attachment to slide up and down conduit 11 and it may be secured in clamping arrangement therewith by means of a clamping bolts 39 and 40.

The two bottom ears 41 and 42 provide means for pivotal attachment of the respective legs 18 and 19. Ear 43 extends upwardly from attachment 21 to provide lifting eye 36.

Figure 5:
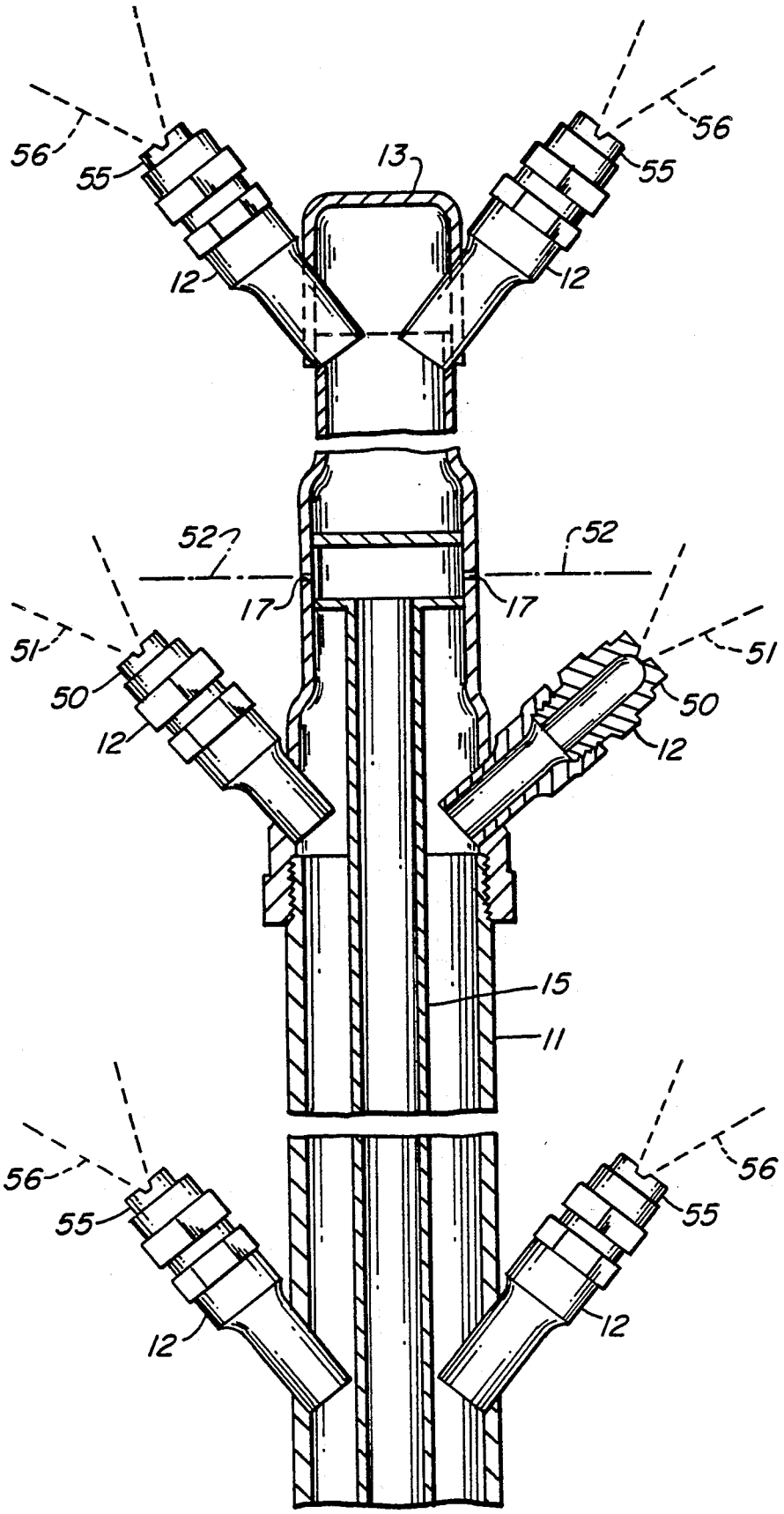
FIG. 5 is an enlarged view in partial section of the upper nozzle end of the portable snow tower structure shown in FIG. 1 as seen along section line V—V.

Referring now to FIG. 5, the upper nozzle discharge end of the portable towers of FIGS. 1 and 2 is illustrated in greater detail.

Water is discharged in the form of a fine spray through first or original nozzles 50 as indicated at 51. Air under pressure is also discharged from orifices 17 in a form of air jet streams 52 which are directed into the throats of the respective water sprays 51 to form a plume of atomized water for making snow.

In order to increase or enhance the efficiency and the total quantity capabilities of the portable snow making tower of the present invention, the four second or additional water discharge nozzles 55 are also provided, and communicate with the interior of water conduit 11 such that they further discharge high velocity fine water sprays 56 which are directed respectively such that they converge with the aforedescribed plumes of atomized water formed as previously described. This permits the snow making quantity capabilities of the portable snow tower of the present invention to approach double its former capabilities even in relatively warm subfreezing conditions such as 28 degrees F.

I claim:

1. A portable snow making tower comprising an elongated water conduit having first discharge nozzle means provided adjacent the upper end thereof, water supply line attachment means at the lower end of said water conduit for supplying water therein under pressure, an air conduit extending substantially coextensive with and secured with said water conduit and having an air discharge orifice adjacent the upper end of said air conduit and said orifice positioned to discharge air therefrom under pressure which is directed into the water discharged from said nozzle means to form a plume of atomized water for making snow, air supply attachment means at the bottom of said air conduit for supplying air therein under pressure, said water conduit positioned at an incline and supported intermediate its upper and lower ends by two legs pivotally attached thereto at their upper ends and spread at their bottom ends thereby forming a tripod configuration including said water supply conduit which may be collapsed by pivoting said legs inwardly toward said water conduit, stop means limiting further pivotal travel of said legs away from said water conduit beyond an outer predetermined limit to stablilize said tripod configuration, skid means on the bottom of said legs permitting said legs to slide along a surface, tow attachment means at the bottom end of said water conduit for towing the snow-making tower on said skid means, said stop means comprising three horizontal cross-braces respectively connected between said legs and between said legs said water conduit, said braces each being readily detachable at one end and pivoted at the other end to permit folding of the tripod configuration.

2. The portable snow making tower of claim 1 including elongation means on at least one of said legs permitting adjustable extension thereof.

3. The portable snow making tower of claim 1 including an anchoring spur at the bottom of said water conduit for anchoring said tripod configuration into the ground.

4. The portable snow making tower of claim 1 characterized in that said air conduit is enclosed within said water conduit to surround it with moving water for insulation.

5. The portable snow making tower of claim 4 including second discharge nozzle means positioned adjacent to said first discharge nozzle means and connected to the water conduit interior to provide at least one additional water discharge directed into said plume.

6. The portable snow making tower of claim 4 wherein said water conduit and said air conduit are comprised of a metallic conducting medium.

7. The portable snow making tower of claim 6 wherein said water conduit is at least fifteen feet long.

8. The portable snow making tower of claim 1 wherein said water conduit is at least fifteen feet long.

9. The portable snow making tower of claim 1 wherein said pivotal attachment of said legs to said water conduit is adapted to slide thereon.

10. The portable snow making tower of claim 9 wherein said slide attachment is provided with clamp means to adjustably stop said sliding arrangement.

11. The portable snow making tower of claim 9 including a pick-up eye on said slide attachment to assist in the maneuverability of the portable snow tower.

12. The portable snow making tower of claim 1 wherein all the connections between said cross-braces and said legs and water conduit are respectively adjustably slidable up and down said legs and water conduit.

13. The portable snow making tower of claim 12 wherein said slidable connections are provided with clamp means to adjustably stop said sliding arrangement.

14. The portable snow making tower of claim 1 wherein said elongated water conduit, said legs and said cross-braces are constructed of tubular stock.

* * * * *